US009341183B1

(12) United States Patent
Carruth et al.

(10) Patent No.: US 9,341,183 B1
(45) Date of Patent: May 17, 2016

(54) PLUNGER ADAPTER WITH SANDWIPER FOR DOWNHOLE PUMP

(71) Applicants: Don V. Carruth, Midland, TX (US); Jyothi Swaroop Samayamantula, Midland, TX (US)

(72) Inventors: Don V. Carruth, Midland, TX (US); Jyothi Swaroop Samayamantula, Midland, TX (US)

(73) Assignee: Don V. Carruth, Midland, TX (US)

( * ) Notice: Subject to any disclaimer, the term of this patent is extended or adjusted under 35 U.S.C. 154(b) by 505 days.

(21) Appl. No.: 13/832,718

(22) Filed: Mar. 15, 2013

Related U.S. Application Data

(60) Provisional application No. 61/620,733, filed on Apr. 5, 2012.

(51) Int. Cl.
*F16J 9/00* (2006.01)
*F04B 53/14* (2006.01)
*F04B 47/00* (2006.01)

(52) U.S. Cl.
CPC ..... *F04B 53/14* (2013.01); *F04B 47/005* (2013.01)

(58) Field of Classification Search
CPC ..... F04B 47/005; E21B 33/08; E21B 37/10
USPC ..... 92/87, 155
See application file for complete search history.

(56) References Cited

U.S. PATENT DOCUMENTS

| | | | |
|---|---|---|---|
| 54,484 | A | 5/1866 | Armstrong |
| 1,178,217 | A | 4/1916 | Conrader |
| 1,455,850 | A | 8/1921 | Penrod et al. |
| 1,422,759 | A | 7/1922 | Green |
| 1,844,780 | A | 2/1932 | Merrick |
| 1,933,595 | A | 11/1933 | Kapp |
| 2,462,257 | A | 2/1949 | Cunningham |
| 2,635,554 | A | 4/1953 | Haley |
| 2,834,300 | A | 5/1958 | Brock |
| 3,090,324 | A | 5/1963 | Schmidt |
| 4,049,365 | A | 9/1977 | Sparks, Sr. |
| 4,194,567 | A | 3/1980 | Marais |
| 4,395,204 | A | 7/1983 | Turner |
| 4,509,365 | A | 4/1985 | Eineichner et al. |
| 5,372,488 | A | 12/1994 | Turner |
| 5,505,258 | A | 4/1996 | Muth |
| 5,618,169 | A | 4/1997 | Smith |
| 5,765,639 | A | 6/1998 | Muth |
| 5,934,372 | A | 8/1999 | Muth |
| 6,007,314 | A | 12/1999 | Nelson, II |
| 6,145,590 | A | 11/2000 | Havard |
| 6,250,392 | B1 | 6/2001 | Muth |
| 6,543,543 | B2 | 4/2003 | Muth |
| 6,746,222 | B2 | 6/2004 | Skillman |

(Continued)

OTHER PUBLICATIONS

Don-Nan Machine and Manufacturing, Drawings of Plunger Sand Diverter and Bushing, pp. 1-5, product sold 2009.

(Continued)

*Primary Examiner* — Michael Leslie
(74) *Attorney, Agent, or Firm* — Grady K. Bergen; Griggs Bergen LLP

(57) ABSTRACT

A downhole reciprocating pump assembly for pumping well-fluids from a wellbore has a cylindrical barrel and a plunger disposed within the barrel. A plunger adapter for such pump assembly is configured to allow passage of sand or other particles through the adapter and into a central bore of the plunger so that it does not enter the space between the outer wall of the plunger and inner wall of the barrel of the pump assembly.

35 Claims, 6 Drawing Sheets

(56) References Cited

U.S. PATENT DOCUMENTS

| | | | |
|---|---|---|---|
| 7,008,197 | B2 | 3/2006 | Ford |
| 7,143,829 | B2 | 12/2006 | Booth |
| 7,428,923 | B2 | 9/2008 | Ford |
| 7,607,901 | B2 | 10/2009 | Williams et al. |
| 7,909,589 | B2 | 3/2011 | Williams |
| 8,535,024 | B2 | 9/2013 | Conyers et al. |
| 2002/0066572 | A1 | 6/2002 | Muth |
| 2005/0265875 | A1 | 12/2005 | Williams et al. |
| 2008/0112826 | A1 | 5/2008 | Ford |
| 2012/0141310 | A1 | 6/2012 | Conyers et al. |
| 2012/0211237 | A1 | 8/2012 | Rich |

OTHER PUBLICATIONS

Don-Nan Machine and Manufacturing, Drawings of Plunger Sand Diverter and Bushing, pp. 1-3, product sold 2009.

Don-Nan Machine and Manufacturing, Drawings of Sand Sucker Plunger, pp. 1-3, product sold 2006.

Wall Colomonoy Corporation, Colmonoy Technical Data Sheet, 1990, pp. 1-2.

PLUNGER ADAPTER WITH SANDWIPER FOR DOWNHOLE PUMP

CROSS-REFERENCE TO RELATED APPLICATIONS

This application claims the benefit of U.S. Provisional Application No. 61/620,733, filed Apr. 5, 2012, which is incorporated herein by reference in its entirety for all purposes.

BRIEF DESCRIPTION OF THE DRAWINGS

For a more complete understanding of the present invention, and the advantages thereof, reference is now made to the following descriptions taken in conjunction with the accompanying figures, in which.

DETAILED DESCRIPTION

Figure 1:
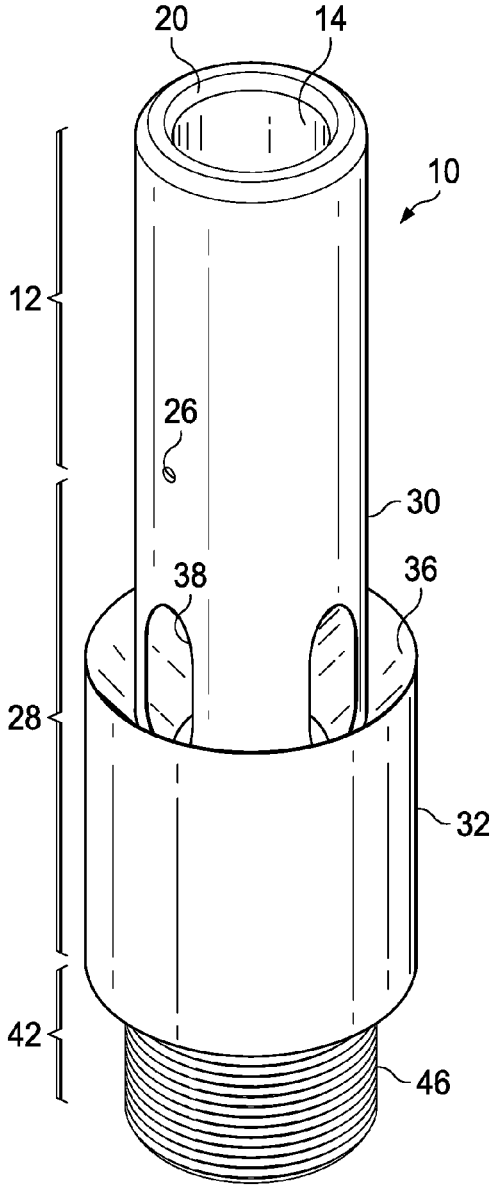
FIG. 1 is a perspective side view a plunger adapter that employs a sandwiper and is configured in accordance with an embodiment of the invention.

Referring to FIG. 1, a plunger adapter 10 is shown for coupling to the upper end of a plunger of a downhole reciprocating pump for pumping wellfluids from a wellbore penetrating a subterranean formation. The adapter 10 is configured for use with a pump assembly having a cylindrical barrel and plunger disposed within the barrel, such as those commonly used with sucker rod pumps or pump jacks in oil wells, for pumping well fluids to the surface.

The adapter 10 may be formed and configured from a single unitary piece of steel, steel alloy or other suitable metal or metal alloy or other material, which forms the adapter body. In other embodiments, the adapter 10 may be formed from multiple components that are coupled together with the various components being non-movable relative to one another during use once coupled together. These materials may be corrosion resistant materials that are suitable for downhole use and environments. Non-limiting examples of suitable materials for the adapter body 10 include Monel 400 (a nickel/copper alloy), 4130 alloy steel, low carbon steels, such as 10XX series steels (e.g., 1018, 1026, etc.). Other materials may also be used. The adapter body 10 is machined or otherwise formed or configured as described herein.

Figure 2:
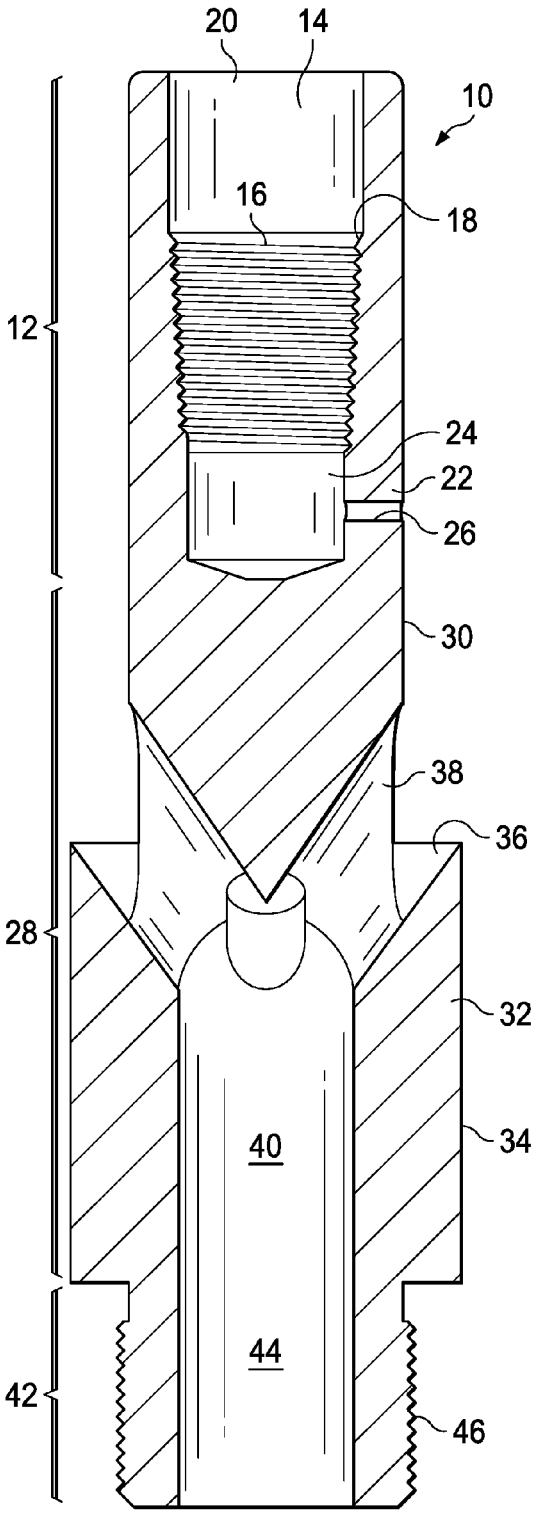
FIG. 2 is a side elevational cross-sectional view of the plunger adapter of FIG. 1.

Referring to FIG. 2, the upper end or section 12 of the adapter 10 constitutes a connector portion for coupling to a rod of a rod string, such as a sucker rod or valve rod. The upper connector section 12 may have a substantially cylindrical configuration and be provided with a central bore or recess 14 for receiving the lower end of a valve rod or sucker rod (not shown) of a rod string. The central bore 14 is shown provided with an internally threaded portion 16 that is sized and configured for engaging and coupling to corresponding threads of the externally threaded end of a rod, such as a valve rod or sucker rod, typically used in well pumps for pumping well fluids to the surface. The upper end of the threaded portion 16 terminates at a sloped annular shoulder portion 18 that slopes upward radially outward (e.g., 35°±10° to 15°) from the perimeter of the threaded portion 16 and extends upward to an upper non-threaded counter bore 20 of the central bore 14. The counter bore 20 is sized and configured for closely receiving the portion of the sucker rod or valve rod immediately above the threaded portion 16 to facilitate stabilization of the rod coupled to the adapter 10 so that less stress is placed on the threaded ends of the coupled valve or sucker rod engaged with the threaded portion 16.

Located below the internally threaded portion 16 is a recessed portion 22 of the upper section 12 having a recess 24. The recess 24 may have a diameter that is smaller than the threaded portion 16 to define an annular shoulder that engages or contacts the lower end of the rod threaded onto threaded portion 16. The recessed portion 22 is provided with one or more pressure equalization ports 26 that communicate from the interior of the recess 24 to the exterior of the adapter 10, such as the exterior of the recessed portion 22. The port(s) 26 allow trapped gases to escape from the area below the threaded sucker rod or valve rod to which the adapter 10 is engaged and coupled. Without the port(s) 26 the pressure buildup within the area 24 can be so great that during disassembly of the rod from the adapter 10 the components can fly apart. The port(s) 26 thus serve to vent any gases that would otherwise be trapped in the area 24. The exhaust port 26 may have a width or diameter of from about 1/32 to about 1/4 inch. In particular embodiments, the port 26 may have a width or diameter of from 1/16 to 1/8 inch.

Located below the upper connector section 12 is an intermediate section 28 of the adapter 10, which is located immediately below the recessed portion 22 of the upper section 12. The intermediate section 28 has a neck portion 30, which may be substantially cylindrical and may have the same or similar width or diameter as the upper section 12. The neck portion 30 may be formed as continuation of the material forming the upper section 12. The intermediate section 28 also has an annular cylindrical collar 32 that joins the neck portion 30 at its lower end. The collar 32 has an outer diameter that is larger than the upper section 12 and neck portion 30 and is sized to be closely received within the barrel of the reciprocating downhole pump with which it is used.

In certain embodiments, the exterior surface of the outer collar 32 is provided with a wear resistant surface 34. This may be achieved by providing a spray metal coating on the outer surface of the collar 32. Such wear resistant coating 34 may have a hardness rating of from 50 to 75, more particularly from 60 to 70, on the Rockwell C metal hardness scale. The coating 34 may have a minimum thickness of 0.005 or 0.010 inch. An example of a suitable thickness may range from 0.010 to 0.060 inch or more. An example of a suitable commercially available wear resistant coating is that marketed under COLMONOY®, e.g., Colmonoy No. 6, which is a nickel-based hard-surface alloy containing 10% chromium boride crystals. Other alloy surface coatings containing various combinations of iron, steel, cobalt, boron, manganese, tungsten, nickel, copper, etc. may also be used to provide the desired wear resistance surface coating.

The width or diameter of the collar 32 is configured to provide a minimal annular clearance between the outer surface of the collar 32 and the inner wall of the barrel of the pump assembly with which it is used. This clearance allows the adapter 10 to reciprocate along with the plunger within the barrel of the pump assembly while preventing sand or other particles from becoming lodged or passing between the exterior of the collar 32 and the barrel of the pump assembly. The collar 32 may be sized and configured to provide an annular clearance ranging from about 0.0010 inch to 0.0025 inch around the circumference of the adapter 10 in the barrel of the pump assembly with which it is employed.

As shown in FIG. 2, the collar 32 of the intermediate portion 28 terminates at its upper end in an annular inner lip or flange 36 that longitudinally overlaps the lower portion of the neck 30 a distance. The upper surface of the lip or flange 36 slopes downwardly and radially from the exterior or periphery of the collar 32 inward towards the lower end of the neck portion 30. As shown, the neck portion 30 has a smaller width or diameter (e.g., from 0.2 inch to 1 inch smaller) than the collar portion 32. The lip or flange 36 forms a sandwiper for collecting and directing sand and other particles toward the center of the adapter 10 and away from the outer periphery of the collar 32.

One or more fluid passages 38 are formed in the neck portion 30 and extend radially inward and axially downward from the exterior of the neck portion 30 to an axially-extending central fluid passage or bore 40 formed in the collar portion 32. If more than one fluid passage 38 is formed (e.g., 3, 4 or 5 passages) in the neck portion 30, these may be circumferentially spaced apart at substantially equal distances that vary depending upon the number of passages provided. In the embodiment shown, there is a set of four (4) fluid passages circumferentially spaced 90° apart at the same longitudinal position. The longitudinal axis of the fluid passages 38 may be angled inwardly relative to a longitudinal axis of the adapter 10 at an angle ranging from 20° to 50°, more particularly from 25° to 45° (e.g., 35°). The angle of the fluid passages 38 may be the same or different than the angle of the lip 36. In the embodiment shown, the lower edge or side of the fluid passages 38 may coincide and be flush with the upper surface of the lip 36. In the embodiment shown, the fluid passages 38 are configured with a transverse cross section configured as elongated slots, each having a slot height that is greater than the width of the slot. As an example, the height-to-width ratio of the fluid passage 38 may range from 1.2 to 2. The elongated slots 38 transverse cross sections may be configured in the form of an oval or have an oblong rectangular midsection that is joined by curved or rounded end portions, as is shown, so that no sharp corners are provided along the length of the fluid passage 38. Other configurations for the fluid passages 38 may also be used.

The lower section 42 of the adapter 10 located below the intermediate portion 28 constitutes a connector portion for coupling to the upper end of a plunger of a pump assembly. The connector portion 42 may be formed from a continuation of the materials forming the upper and intermediate sections 12, 28. The connector portion 42 is also provided with a central axial passage or bore 44 that is in fluid communication with the central bore 40 of the intermediate portion 28. In the embodiment shown, the central passages 40, 44 are generally coincidental and have the same diameter so that they essentially function as a single continuous or non-interrupted fluid passage of uniform width or diameter along its length.

The connector portion 42 is shown configured with external helical threads 46 that are sized and configured for coupling to the internal-threaded portion of an upper box-end plunger of a pump assembly. The connector portion 42 can have other configurations as well, in other embodiments. Thus, for example, the connector portion 42 can be provided with internal threads (not shown) for connecting with an upper pin-end plunger (not shown) having cooperating external threads.

The adapter 10 is small in size and is configured to consume very little space within the barrel of the pump assembly. The overall length or height of the adapter 10 may range from 5 to 8 inches. The collar portion 32 may have a height ranging from 1 to 3 inches. The adapter 10 is separate from the plunger of the pump assembly so that the sucker or valve rod may be coupled to the adapter 10 and not directly to the plunger. The flow space defined by the areas of the fluid passages 38 and central bores 40, 44 of the collar 32 and lower section 42, respectively, will typically be equal to or greater than the flow space of the minimum restriction of the plunger or valve openings (e.g., ball and seat) of the pump assembly with which the adapter 10 is used so that fluid flow is not further restricted by the adapter 10 during pumping operations.

Figure 3:
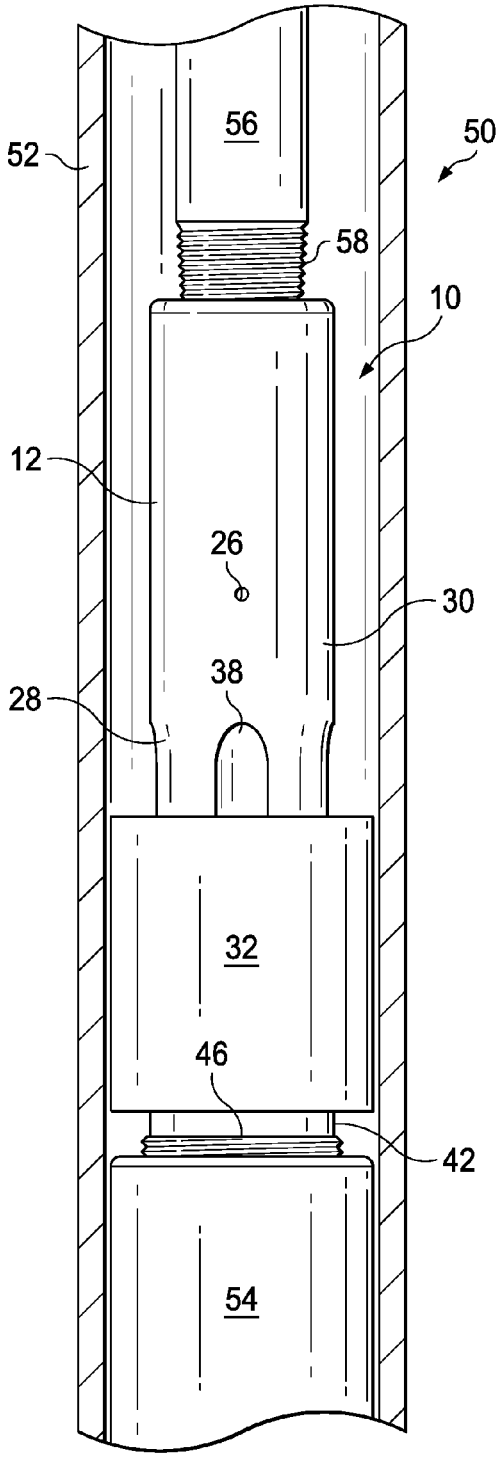
FIG. 3 is a side elevational view of a pump assembly employing the plunger adapter of FIG. 1.

Referring to FIG. 3, the adapter 10 is shown in use with a reciprocating downhole pump assembly 50. The pump assembly 50 is shown with a cylindrical barrel 52 and plunger 54 disposed within the barrel 52. The upper end of the plunger 54 is shown provided with a box end having internal threads that engage the threaded portion 46 of the lower section 42 of the adapter 10. The plunger 54 and adapter 10 are positioned within the barrel 52 of the pump assembly 50. The upper section 12 is coupled to the rod 56 of a rod string through threaded portion 58 of the rod 56.

In use during pumping operations, during the downward stroke, well fluids (and entrained sand or other particles) flow upward through the bore (not shown) of the coupled plunger 54 and into the internal bores 40, 44 of the adapter 10 and through the fluid ports 38. During the upward stroke and when the pump is stationary, sand is prevented from entering the space between plunger and barrel located below the adapter 10 by the sand lip 36 and the close spacing between the collar 32 and inner wall of the barrel 52 of the pump assembly 50. The sand is directed back down through the adapter 10 through the fluid ports 38 and out the adapter 10 through the bore 44 into the interior central bore of the plunger 54 where there is less likelihood the sand will enter the space between the outer wall of the plunger 54 and inner wall of the barrel 52 of the pump assembly 50.

Figure 4:
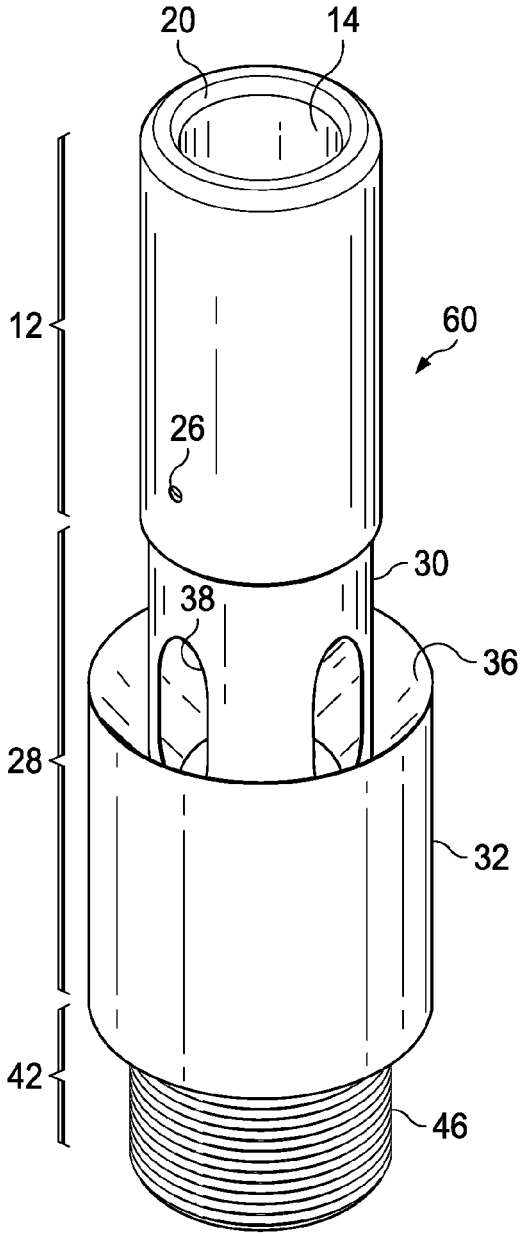
FIG. 4 is a perspective side view of an alternate embodiment of a plunger adapter having narrowed neck and constructed in accordance with an embodiment of the invention.

Referring to FIG. 4 an alternate embodiment of a plunger adapter 60 is shown. The plunger adapter 60 is similar to the adapter 10, previously described, with similar components labeled with the same reference numerals. The plunger adapter 60 differs from the plunger adapter 10 in that the neck 30, or the lower portion thereof, has a slightly smaller diameter (e.g., from 0.05 inch to 0.25 inch smaller) than the diameter of the upper section 12. The reduced diameter of the neck 30 allows more fluid and sand particles to flow into the annular space between the pump barrel 52 and neck 30 so that they are more easily removed through the fluid passages 38. The operation of the adapter 60 is generally the same as the adapter 10, previously described.

Figure 5:
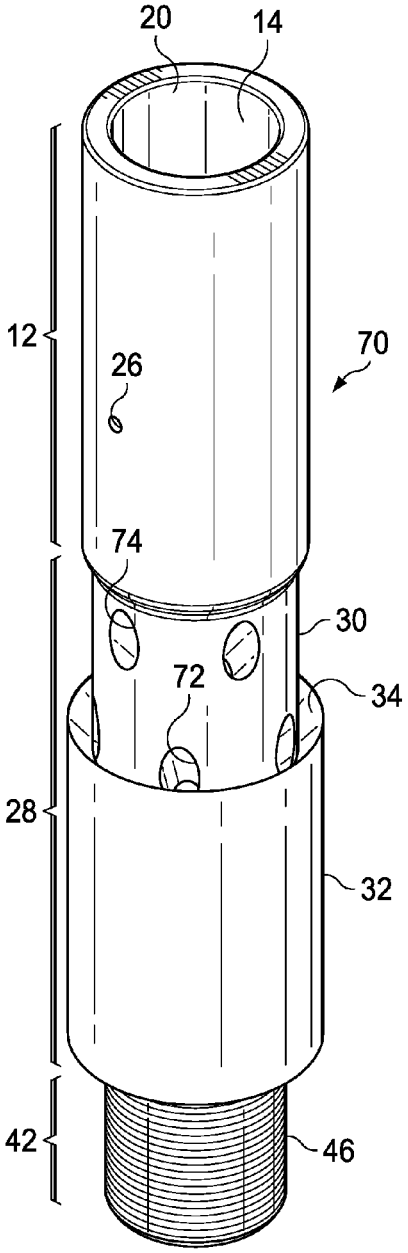
FIG. 5 is a perspective side view of another alternate embodiment of a plunger adapter employing longitudinally spaced apart fluid flow passages and constructed in accordance with an embodiment of the invention.
Figure 6:
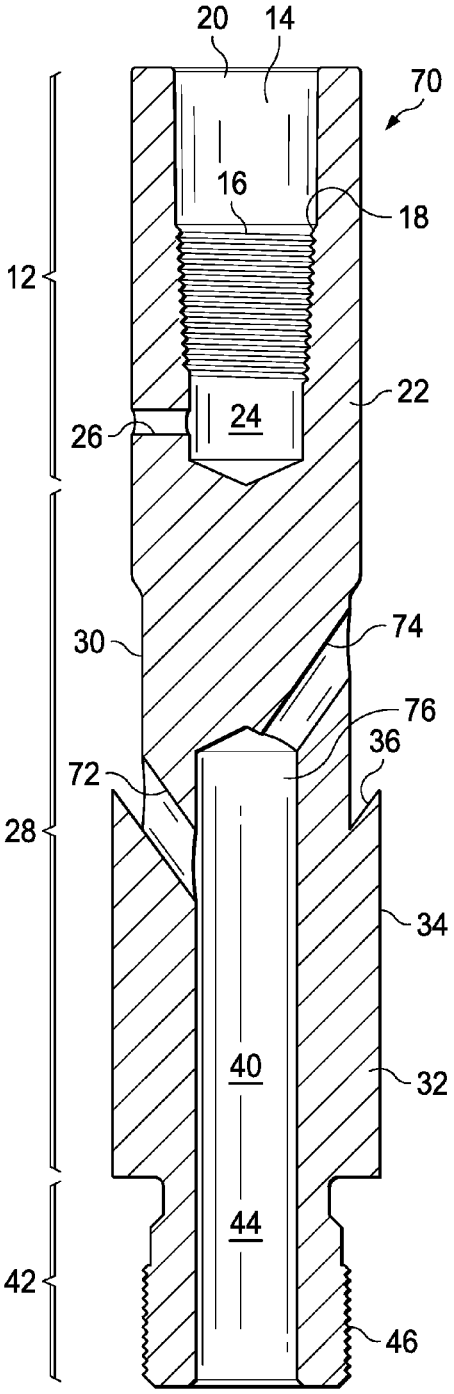
FIG. 6 is a side elevational cross-sectional view of the plunger adapter of FIG. 5.

Referring to FIGS. 5 and 6, another embodiment of a plunger adapter 70 is shown. The plunger adapter 70 is similar to the plunger adapters 10 and 60, previously described, with similar components labeled with the same reference numerals. The plunger adapter 70 is similar to the plunger adapter 60 in that the diameter of the neck portion 30 is slightly smaller diameter (e.g., from 0.05 inch to 0.25 inch smaller) than the upper section 12.

The plunger adapter 70 differs from those previously described in that it is provided with two or more sets of fluid passages 72, 74 that are longitudinally spaced apart from each other in two or more planes or have openings on the exterior of the adapter 70 that are longitudinally spaced apart. In the embodiment shown, the fluid passages 72 constitute lower fluid passages and the fluid passages 74 constitute upper fluid passages. Additionally, the lower fluid passages 72 are shown as being circumferentially spaced apart or staggered from the upper fluid passages 74. The lower fluid passages 72 may be circumferentially spaced or staggered at equal or non-equal circumferential distances. In other embodiments, however, one or more or all of the lower and upper fluid passages 72, 74 may be circumferentially aligned (i.e., one directly above the other).

As shown in FIG. 6, an axially-extending central bore 76 is provided in the lower portion the neck portion 30 that communicates with and joins the central bore 40 of the collar 32, thus forming an extension or continuation of the central bore 40 of the collar 32 in the intermediate section 28. The upper fluid passages 74 extend radially inward from the exterior of the neck 30 to the central bore 76 of the neck 30. The lower fluid passages 72 extend radially inward from the exterior of the neck 30 to the central bore 40 of the collar 42. The fluid passages 72, 74 may be angled inwardly relative to a longitudinal axis of the adapter 70 at an angle ranging from 20° to 50°, more particularly from 25° to 45° (e.g., 35°). The angle of the lower fluid passages 72 and the angle of the upper fluid passages 74 may be the same or different from one another. The angle of the lower fluid passages 72 may the same or different than the angle of the lip 36. In the embodiment shown, the lower edge or side of the fluid passages 72 may coincide and be flush with the surface of the lip 36.

The lowermost edge of the upper fluid passages 74 located at the junction of the fluid passages 74 and the central bore 76 may be located at a position at or above the uppermost edge of the lower fluid passages 72 at the junction of the fluid passage 72 and the exterior of the neck 30. In other embodiments, there may be some longitudinal overlap in the lowermost edge of the fluid passages 74 and the uppermost edge of the lower fluid passages 72.

The fluid passages 72, 74 may have the same or different transverse cross-sectional configuration from one another and may be the same or different sizes. The fluid passages 72, 74 may have a non-elongated transverse cross section, such as a circular cross section. In the embodiment shown, each of the fluid passages 72, 74 have a uniform circular transverse cross section that extends along their entire lengths. In the particular embodiment shown, there are five (5) lower fluid passages 72 that are circumferentially space apart 72° and there are five (5) upper fluid passages 74 that are circumferentially space apart 72° and staggered from the lower fluid passages 72 by 36°, for a total of ten (10) fluid passages total.

The operation and use of the plunger adapter 70 is the same or similar to the adapters 10 and 60, previously described. By utilizing a greater number of flow passages in the adapter 70, the lower and upper fluid passages 72, 74 may be smaller in diameter or dimension than the flow passages 38, previously described, but provide the same or a greater total flow space area because of their larger numbers. Additionally, because of their smaller size and by arranging them in a longitudinally staggered configuration, they may provide a structurally stronger adapter with more material being provided between the flow passages 72, 74 that provides structurally stronger areas that are less prone to failure.

Figure 7:
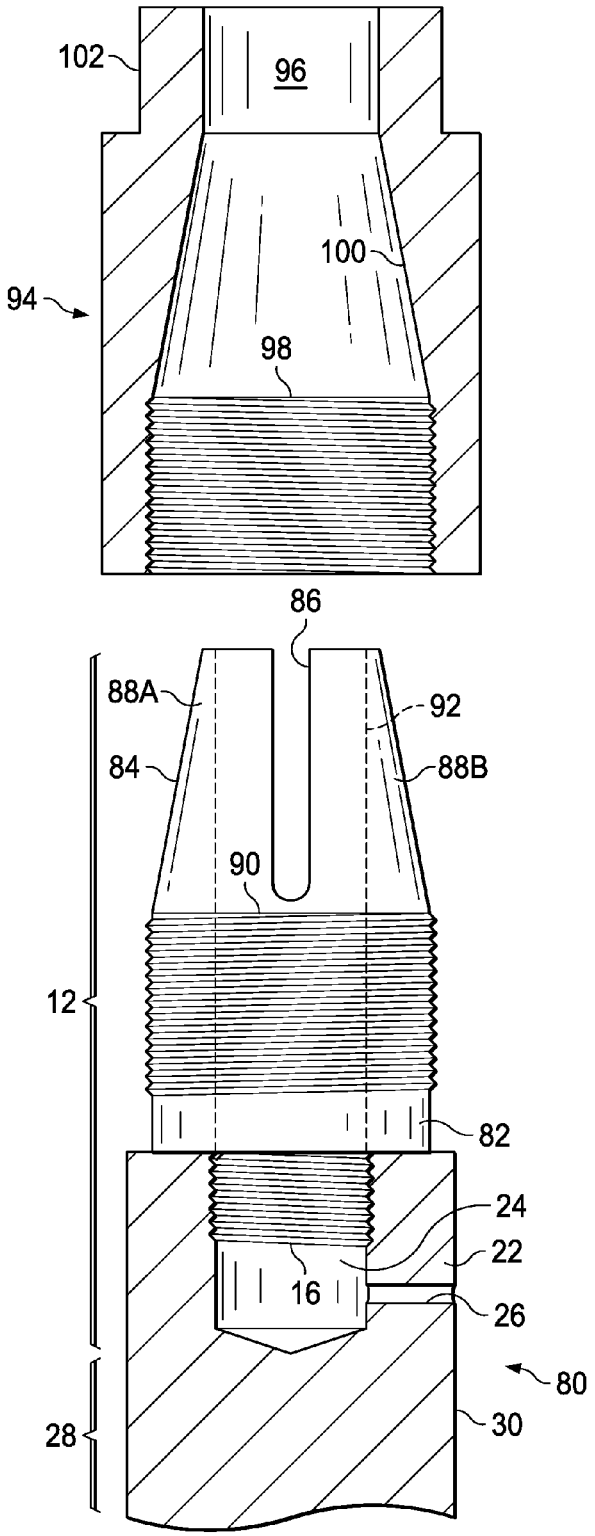
FIG. 7 is partially sectioned side elevational view of a collet portion of a plunger adapter and an elevational cross-sectional view of a locking nut employed with the collet portion and constructed in accordance with an embodiment of the invention.

FIG. 7 shows another embodiment of a plunger adapter 80 with the upper section 12 being shown. The upper section 12 is similar to the upper sections 12 of the adapters 10, 60, 70, with similar components being labeled with the same reference numerals. The upper section 12 differs, however, in that the uppermost portion 82 of the upper section 12 is configured as a collet portion with an upper tapered portion 84. The exterior of the tapered portion 84 may have an exterior frustoconical or tapered configuration and have one or more transverse slots 86 that extend the length of the tapered portion 84 and divides the tapered portion 84 into two or more tapered segments 88A, 88B.

Directly below the tapered portion 84 is an externally threaded portion 90. A central bore 92 extends through the tapered portion 84 and threaded portion 90 and generally corresponds to the counter bore 20 of the adapters 10, 60, 70.

A collet lock nut 94 is provided with the adapter 80. The lock nut 94 is formed as a separate body, which may be formed from the same or similar materials as the remainder of the adapter 80 or different materials. The lock nut 94 is configured to engage the upper collet portion 82 and has a central passage 96 with an internally threaded portion 98 for engaging the external threads 90. An internally tapered portion 100 extends upward from the threaded portion 98 and corresponds to the tapered portion 84.

Nut flats 102 or other tool engagement structures are provided on the lock nut 94 to facilitate engagement of the lock nut with a wrench or tool (not show) for tightening and loosening of the nut 94 upon the collet portion 82.

When the lower end of a pump rod, such as the rod 56 (FIG. 3), is threaded to the threaded portion 16 of the upper section 12 of the adapter 80, the portion of the rod 56 above the threaded portion 16 is received within the central bore 92. By tightening the lock nut 94 over the collet portion 82, the tapered segments 88 are wedged by the tapered walls of the tapered portion 98 of the lock nut 94 so that the segments 88 are forced together around the rod 56 to thereby securely hold the rod 56 within the central bore 92. This facilitates placing less stress on threaded ends of the rod 56 engaged with the threaded portion 16 of the adapter 80.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

We claim:

1. A plunger adapter for coupling to the upper end of a plunger of a downhole reciprocating pump having a cylindrical barrel with the plunger disposed within the barrel, the plunger adaptor comprising:

an upper connector section having a central bore with a threaded rod engagement portion for engaging threads of a threaded end of a rod of a rod string;

an intermediate section having a neck joined at an upper end to the upper connector section and an annular cylindrical collar that joins a lower end of the neck, the collar having an outer diameter that is greater than the width of the upper connector section and neck, the collar terminating at an upper end in an annular lip or flange that longitudinally overlies a lower portion of the neck, the annular lip or flange sloping downwardly and radially inward towards the lower end of the neck to form a sandwiper to facilitate collecting and directing sand and other particles away from the periphery of the collar, at least two fluid passages being formed in the neck that are longitudinally spaced apart from one another, wherein each fluid passage extends radially inward and axially downward from the exterior of the neck to an axially-extending central fluid passage formed in the intermediate section; and a lower section located below and joined to the intermediate section, the lower section being configured for coupling to the upper end of the plunger and having a central fluid passage that communicates with the central passage of the collar.

2. The plunger adapter of claim 1, wherein:

the upper connector section, the intermediate section and lower section are each formed from a single unitary piece of material.

3. The plunger adapter of claim 1, wherein:

the upper section includes a non-threaded counter bore located above the threaded rod engagement portion configured for closely receiving a non-threaded portion of a valve or sucker rod.

4. The plunger adapter of claim 1, wherein:

the neck has a smaller diameter than the upper section.

5. The plunger adapter of claim 1, wherein:

the upper section includes a recessed portion having a recess located below the threaded rod engagement portion provided with one or more pressure equalization ports that communicate between the interior of the recess to the exterior of the plunger adapter.

6. The plunger adapter of claim 1, wherein:

the at least two fluid passages have a generally circular transverse cross section.

7. The plunger adapter of claim 1, wherein:

the exterior of the collar has a wear resistant surface provided by a wear resistant coating having a hardness of from 50 to 75 on a Rockwell C metal hardness scale.

8. The plunger adapter of claim 1, wherein:

at least one fluid passage formed in the neck has a longitudinal axis angled inwardly relative to a longitudinal axis of the adapter at an angle ranging from 20° to 50°.

9. The plunger adapter of claim 1, wherein:

at least one fluid passage formed in the neck is formed as an elongated slot.

10. The plunger adapter of claim 1, wherein:

the plunger adapter has an overall length of from 5 to 8 inches.

11. The plunger adapter of claim 1, wherein:

the upper connector section is configured as a collet in the form of a tapered portion that is slotted to form at least two tapered segments, the upper connector section having an externally threaded portion; and further comprising a collet lock nut having a tapered inner bore that is configured to engage the exterior of the collet and having an internally threaded portion that engages the externally threaded portion of the collet.

12. The plunger adapter of claim 1, wherein:

the plunger adapter is incorporated into a downhole reciprocating pump assembly, the pump assembly comprising a cylindrical barrel, a plunger disposed within the barrel, and the plunger adapter.

13. A plunger adapter for coupling to the upper end of a plunger of a downhole reciprocating pump having a cylindrical barrel with the plunger disposed within the barrel, the plunger adaptor comprising:

an upper connector section having a central bore with a threaded rod engagement portion for engaging threads of a threaded end of a rod of a rod string;

an intermediate section having a neck joined at an upper end to the upper connector section and an annular cylindrical collar that joins a lower end of the neck, the collar having an outer diameter that is greater than the width of the upper connector section and neck, the collar terminating at an upper end in an annular lip or flange that longitudinally overlies a lower portion of the neck, the annular lip or flange sloping downwardly and radially inward towards the lower end of the neck to form a sandwiper to facilitate collecting and directing sand and other particles away from the periphery of the collar, at least one fluid passage being formed in the neck as an elongated slot that extends radially inward and axially downward from the exterior of the neck to an axially-extending central fluid passage formed in the intermediate section; and a lower section located below and joined to the intermediate section, the lower section being configured for coupling to the upper end of the plunger and having a central fluid passage that communicates with the central passage of the collar.

14. The plunger adapter of claim 13, wherein:

the upper connector section, the intermediate section and lower section are each formed from a single unitary piece of material.

15. The plunger adapter of claim 13, wherein:

the upper section includes a non-threaded counter bore located above the threaded rod engagement portion configured for closely receiving a non-threaded portion of a valve or sucker rod.

16. The plunger adapter of claim 13, wherein:

the upper section includes a recessed portion having a recess located below the threaded rod engagement portion provided with one or more pressure equalization ports that communicate between the interior of the recess to the exterior of the plunger adapter.

17. The plunger adapter of claim 13, wherein:

the neck has a smaller diameter than the upper section.

18. The plunger adapter of claim 13, wherein:

there are at least two fluid passages formed in the neck that are longitudinally spaced apart from one another.

19. The plunger adapter of claim 13, wherein:

the exterior of the collar has a wear resistant surface provided by a wear resistant coating having a hardness of from 50 to 75 on a Rockwell C metal hardness scale.

20. The plunger adapter of claim 13, wherein:

the at least one fluid passage formed in the neck has a longitudinal axis angled inwardly relative to a longitudinal axis of the adapter at an angle ranging from 20° to 50°.

21. The plunger adapter of claim 13, wherein:

the plunger adapter has an overall length of from 5 to 8 inches.

22. The plunger adapter of claim 13, wherein:

the upper connector section is configured as a collet in the form of a tapered portion that is slotted to form at least two tapered segments, the upper connector section having an externally threaded portion; and further comprising a collet lock nut having a tapered inner bore that is configured to engage the exterior of the collet and having an internally threaded portion that engages the externally threaded portion of the collet.

23. The plunger adapter of claim 13, wherein:

the plunger adapter is incorporated into a downhole reciprocating pump assembly, the pump assembly comprising a cylindrical barrel, a plunger disposed within the barrel, and the plunger adapter.

24. A plunger adapter for coupling to the upper end of a plunger of a downhole reciprocating pump having a cylindrical barrel with the plunger disposed within the barrel, the plunger adaptor comprising:

an upper connector section having a central bore with a threaded rod engagement portion for engaging threads of a threaded end of a rod of a rod string;

an intermediate section having a neck joined at an upper end to the upper connector section and an annular cylindrical collar that joins a lower end of the neck, the collar having an outer diameter that is greater than the width of the upper connector section and neck, the collar terminating at an upper end in an annular lip or flange that longitudinally overlies a lower portion of the neck, the annular lip or flange sloping downwardly and radially inward towards the lower end of the neck to form a sandwiper to facilitate collecting and directing sand and other particles away from the periphery of the collar, at least one fluid passage being formed in the neck that extends radially inward and axially downward from the exterior of the neck to an axially-extending central fluid passage formed in the intermediate section; and a lower section located below and joined to the intermediate section, the lower section being configured for coupling to the upper end of the plunger and having a central fluid passage that communicates with the central passage of the collar; and wherein the upper connector section is configured as a collet in the form of a tapered portion that is slotted to form at least two tapered segments, the upper connector section having an externally threaded portion; and further comprising a collet lock nut having a tapered inner bore that is configured to engage the exterior of the collet and having an internally threaded portion that engages the externally threaded portion of the collet.

25. The plunger adapter of claim 24, wherein:

the upper connector section, the intermediate section and lower section are each formed from a single unitary piece of material.

26. The plunger adapter of claim 24, wherein:

the upper section includes a non-threaded counter bore located above the threaded rod engagement portion configured for closely receiving a non-threaded portion of a valve or sucker rod.

27. The plunger adapter of claim 24, wherein:

the upper section includes a recessed portion having a recess located below the threaded rod engagement portion provided with one or more pressure equalization ports that communicate between the interior of the recess to the exterior of the plunger adapter.

28. The plunger adapter of claim 24, wherein:

the neck has a smaller diameter than the upper section.

29. The plunger adapter of claim 24, wherein:

there are at least two fluid passages formed in the neck that are longitudinally spaced apart from one another.

30. The plunger adapter of claim 29, wherein:

the at least two fluid passages have a generally circular transverse cross section.

31. The plunger adapter of claim 24, wherein:

the exterior of the collar has a wear resistant surface provided by a wear resistant coating having a hardness of from 50 to 75 on a Rockwell C metal hardness scale.

32. The plunger adapter of claim 24, wherein:

the at least one fluid passage formed in the neck has a longitudinal axis angled inwardly relative to a longitudinal axis of the adapter at an angle ranging from 20° to 50°.

33. The plunger adapter of claim 24, wherein:

the at least one fluid passage formed in the neck is formed as an elongated slot.

34. The plunger adapter of claim 24, wherein:

the plunger adapter has an overall length of from 5 to 8 inches.

35. The plunger adapter of claim 24, wherein:

the plunger adapter is incorporated into a downhole reciprocating pump assembly, the pump assembly comprising a cylindrical barrel, a plunger disposed within the barrel, and the plunger adapter.

* * * * *